US005287041A

United States Patent [19]

Lee

[11] Patent Number: 5,287,041

[45] Date of Patent: Feb. 15, 1994

[54] SIDE PIN CUSHION CIRCUIT

[75] Inventor: Kang Woo Lee, Anang, Rep. of Korea

[73] Assignee: Gold Star Co., Ltd., Seoul, Rep. of Korea

[21] Appl. No.: 913,425

[22] Filed: Jul. 15, 1992

[30] Foreign Application Priority Data

Jul. 15, 1991 [KR] Rep. of Korea ..... 1991 10913

[51] Int. Cl.[5] ..... G09G 1/04; H01J 29/56; H01J 29/72

[52] U.S. Cl. ..... 315/371; 315/393

[58] Field of Search ..... 315/371, 393

[56] References Cited

U.S. PATENT DOCUMENTS

| | | | |
|---|---|---|---|
| 4,365,270 | 12/1989 | Rutishauser | 358/140 |
| 4,547,708 | 10/1985 | Haferl | 315/371 |
| 4,691,147 | 9/1987 | Kashiwagi | 315/371 |
| 4,827,193 | 5/1989 | Watanuki et al. | 315/371 |
| 5,113,122 | 5/1992 | Bando et al. | 315/371 |

*Primary Examiner*—Gregory C. Issing
*Attorney, Agent, or Firm*—Keck, Mahin & Cate

[57] ABSTRACT

A side pin cushion circuit for keeping exact the period corresponding to the frequency of a synchronizing signal so as to prevent a pin cushion distortion in a cathode ray tube displayer. The side pin cushion circuit comprises a vertical deflection portion for generating a saw-tooth signal whose period varies according to the frequency of a vertical synchronizing signal, first amplifying portion for amplifying the saw-tooth signal supplied from the vertical deflection portion and converting the amplified saw-tooth signal to a pin cushion signal, a second amplifying portion for amplifying the pin cushion signal supplied from the first amplifying portion and supplying the amplified pin cushion signal to a mixer, a controlling switch for switching the pin cushion signal supplied to the mixer from the second amplifying portion, and a switch controller for detecting the frequency of the vertical sychronizing signal depending on the voltage level of the saw-tooth signal supplied from the vertical deflection portion and for controlling the controlling switch every period corresponding to the frequency of the detected vertical synchronizing signal.

5 Claims, 4 Drawing Sheets

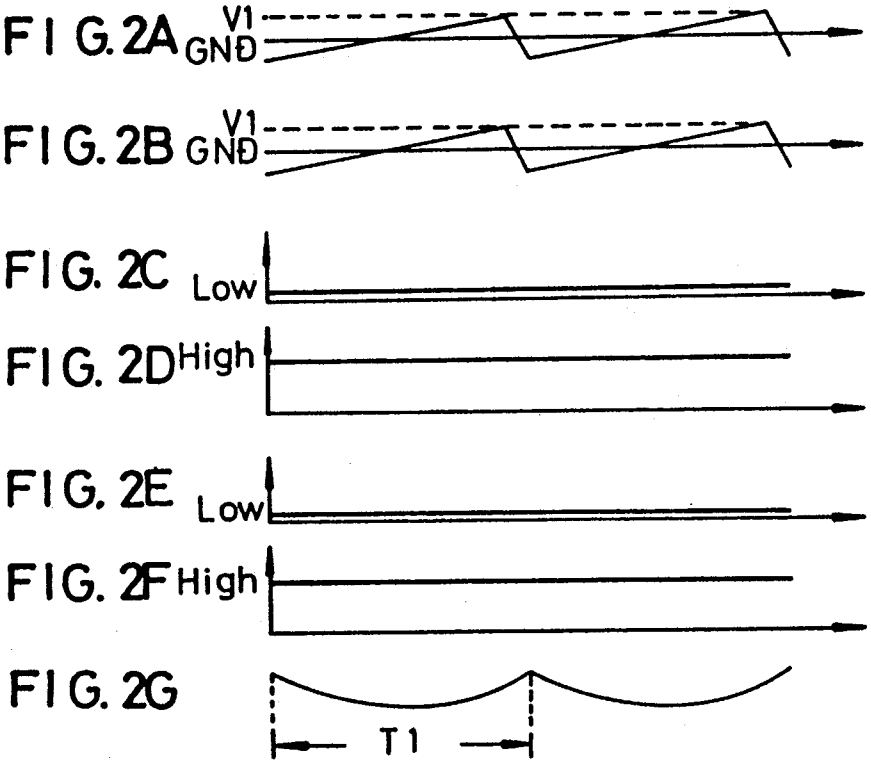
FIG. 2A
FIG. 2B
FIG. 2C
FIG. 2D
FIG. 2E
FIG. 2F
FIG. 2G
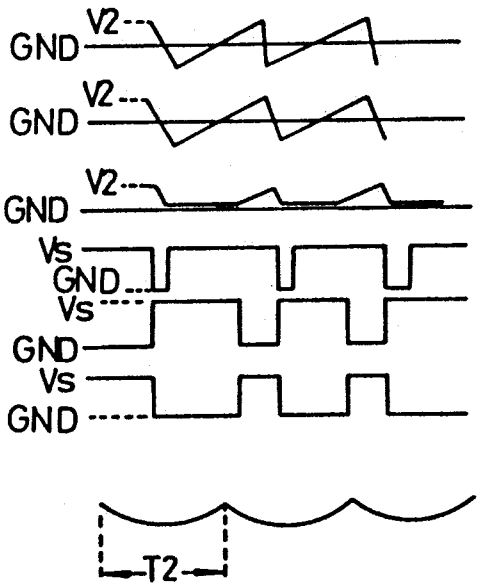
FIG. 3A
FIG. 3B
FIG. 3C
FIG. 3D
FIG. 3E
FIG. 3F
FIG. 3G

SIDE PIN CUSHION CIRCUIT

BACKGROUND OF THE INVENTION

The present invention relates to a circuit for preventing a pin cushion distortion in a television receiver or a monitor having a cathode ray tube, and more particularly to a circuit which can generate a pin cushion signal having an exact period according to the frequency of a sychronizing signal.

As shown in FIG. 4, a conventional side pin cushion circuit comprises a transistor Q51 for inverting and amplifying a synchronizing signal, a transistor Q52 for generating a saw-tooth signal, transistors Q53 to Q55 with cascaded connections for outputting a pin cushion signal, resistors R51 to R67 for supplying a bias voltage to the transistors Q51 to Q55, diodes D51 to D54, and coupling capacitors C51 to C56.

The operation of the conventional side pin cushion circuit constituted as shown in FIG. 4 is described as follows.

The transistor Q51 inverts and amplifies a vertical synchronizing signal, as shown in FIG. 5A, supplied to its base through an input terminal 50 and a resistor R51 and supplies the inverted and amplified signal, as shown in FIG. 5B, to the base of the transistor Q52 through the two resistors R52 and R53. Then the transistor Q52 is turned on/off according to the logic state of the inverted and amplified vertical synchronizing signal supplied to its base, to open and close the current passage connected through its collector and emitter to a second power source GND. At this time, the capacitor C51 charges and discharges according to the switching operation of the transistor Q52, thereby generating saw-tooth signal as shown in FIG. 5C to supply to the base of the transistor Q53.

Meanwhile, the transistor Q53 with the resistor R56 and the capacitor C52 integrates and amplifies the saw-tooth signal supplied to its base and generates a pin cushion signal such as that of FIG. 5D. And the transistor Q53 supplies the generated pin cushion signal to the base of the transistor Q54 through a coupling capacitor C53. At this time, the resistor R55 limits the current flowing in the capacitors C51 and C52.

The transistor Q54 together with four resistors R57 to R60 constitute an amplifying circuit, which inverts and amplifies the pin cushion signal supplied to its base into the pin cushion signal of FIG. 5E and supplies this inverted and amplified pin cushion signal to the base of the transistor Q55 through a current limiting resistor R61, a coupling capacitor C54, and a current limiting resistor R62.

The transistor Q55 together with four resistors R63 to R66 and two capacitors C55 and C56 constitute another amplifying circuit, which again inverts and amplifies the inverted pin cushion signal of FIG. 5E supplied to its base, and supplies an amplified pin cushion signal such as that of FIG. 5F to a mixer (not shown) through a resistor R67 and an output terminal 51. Then the mixer amplitude-modulates the horizontal deflection signal of a saw-tooth waveform supplied from a horizontal deflection portion (not shown) according to the pin cushion signal, and supplies the modulated horizontal deflection signal to a deflection coil of a cathode ray tube.

However, the side pin cushion circuit, as shown in FIG. 4, generates a distortion of the signals in the steps of amplifying the vertical synchronizing signal of the square wave form, converting the amplified vertical synchronizing signal to a saw-tooth signal, and again converting the converted saw-tooth signal to a pin cushion signal, such that it cannot exactly keep the period of the pin cushion signal. Because of this, the conventional side pin cushion circuit is applicable only to a cathode ray tube displayer for a single mode having a constant frequency of the vertical synchronizing signal. It is not applicable to a cathode ray tube displayer for multiple modes using a plurality of vertical synchronizing signals having different frequencies, because the distortion of the pin cushion signal according to the frequency of the vertical synchronizing signal is generated.

BRIEF DESCRIPTION OF THE INVENTION

Accordingly, it is an object of the present invention to provide a side pin cushion circuit which can keep the period of the pin cushion signal exactly according to the frequency of a vertical synchronizing signal, so as to be suitable for a multiple-mode cathode ray tube displayer using a plurality of vertical synchronizing signals having different frequencies.

To achieve the object, the side pin cushion circuit of the present invention comprises vertical deflection means for generating a saw-tooth signal having a frequency varying according to the frequency of the vertical synchronizing signal, first amplifying means for amplifying a saw-tooth signal from the vertical deflection means and converting the amplified saw-tooth signal to a pin cushion signal, second amplifying means for amplifying the pin cushion signal supplied from the first amplifying means and supplying the amplified pin cushion signal to a mixer, switching means for switching the pin cushion signal supplied to the mixer from the second amplifying means, and switch controlling means for detecting the frequency of the vertical synchronizing signal by the voltage level of the saw-tooth signal supplied from the vertical deflection means and for controlling the switching means every period corresponding to the frequency of the detected vertical synchronizing signal.

BRIEF DESCRIPTION OF THE DRAWINGS

The above object and other advantages of the present invention will become more apparent by describing the preferred embodiment of the present invention with reference to the attached drawings, in which:

FIGS. 2A to 2G show the output waveforms generated by the several portions of the circuit shown in FIG. 1 when the frequency of the vertical synchronizing signal is low;

FIGS. 3A to 3G show the output waveforms generated by the several portions of the circuit shown in FIG. 1 when the frequency of the vertical synchronizing signal is high;

DETAILED DESCRIPTION OF THE INVENTION

Figure 1:
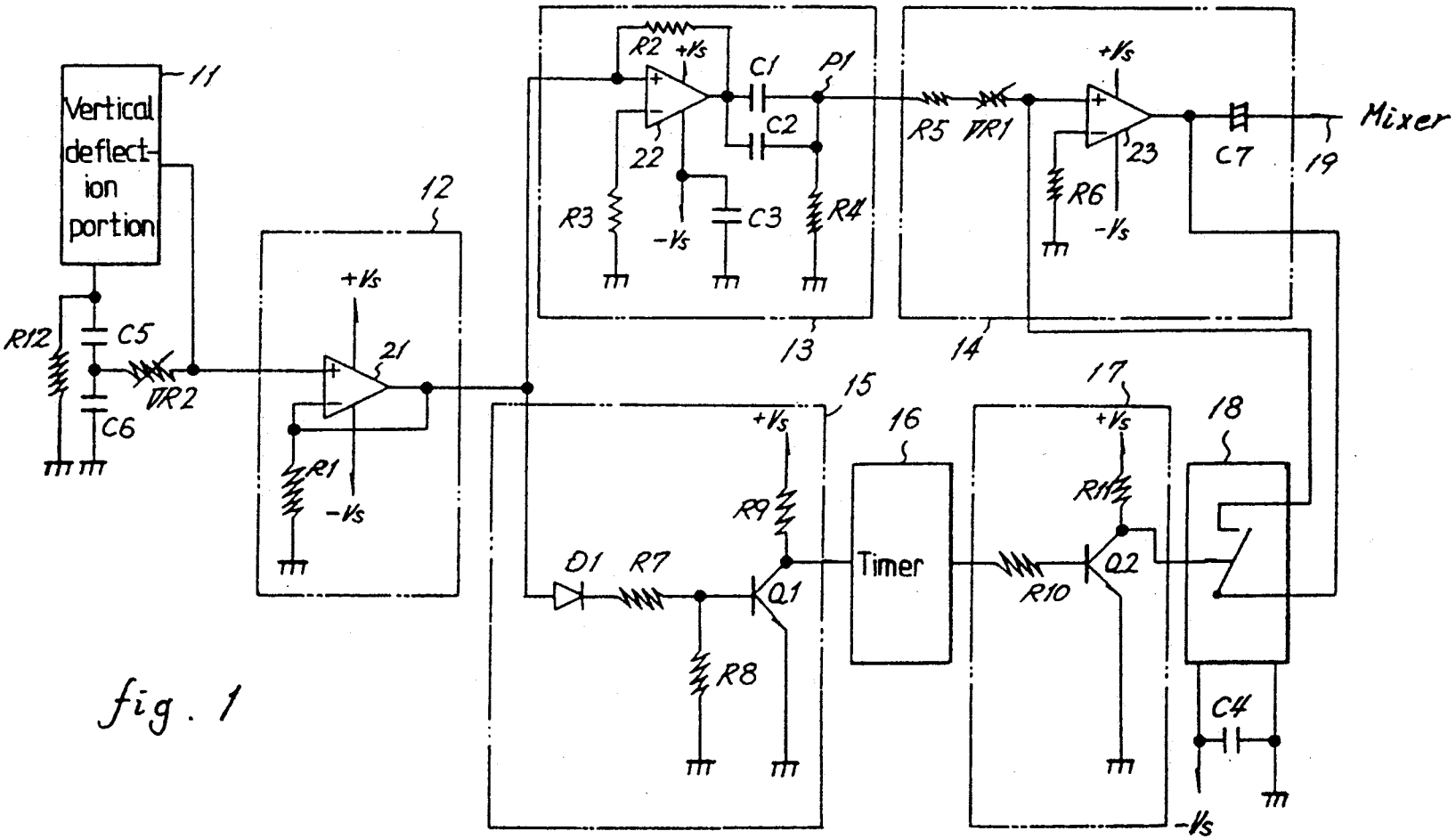
FIG. 1 is a circuit diagram of a side pin cushion circuit according to an embodiment of the present invention.
Figure 4:
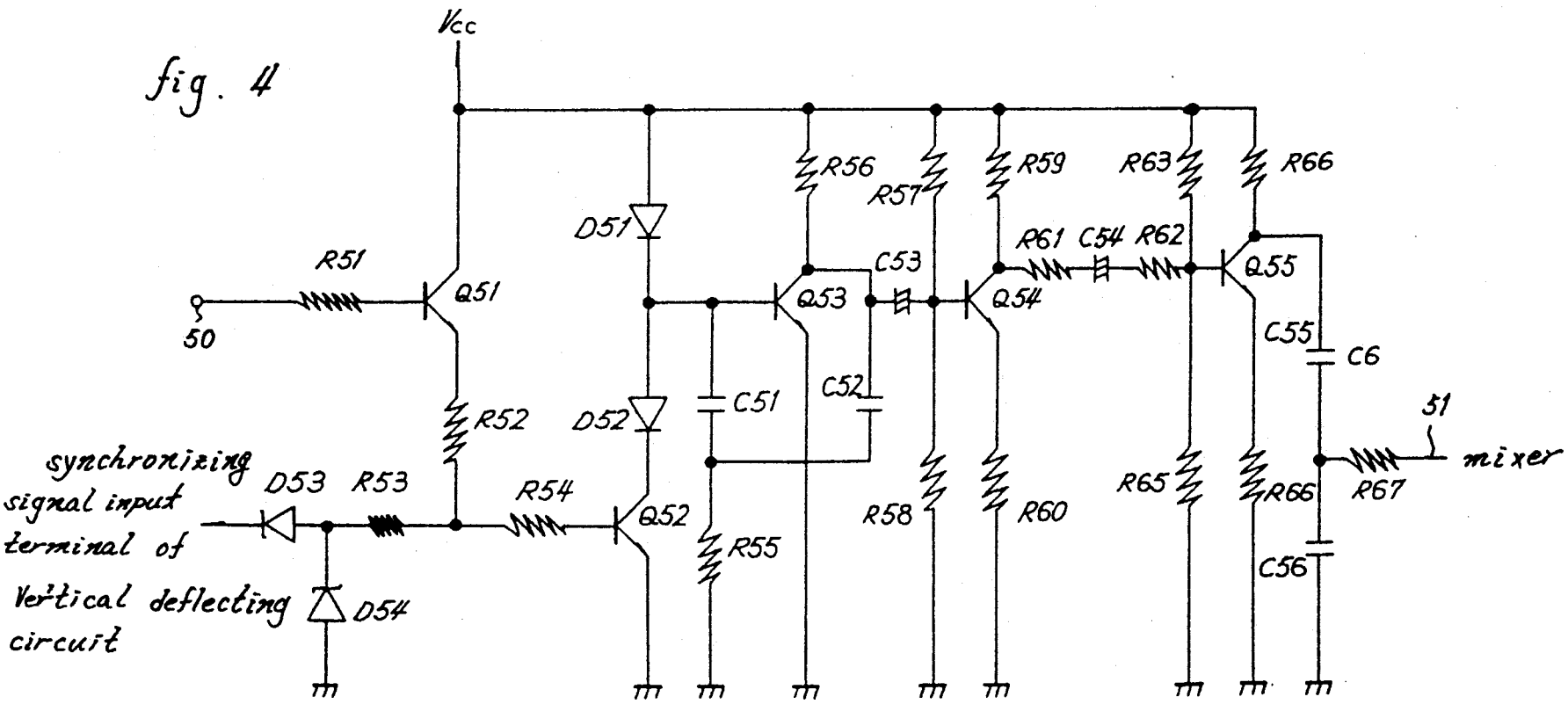
FIG. 4 is a circuit diagram of the conventional side pin cushion circuit.
Figures 5A, 5B, 5C, 5D, 5E, 5F:
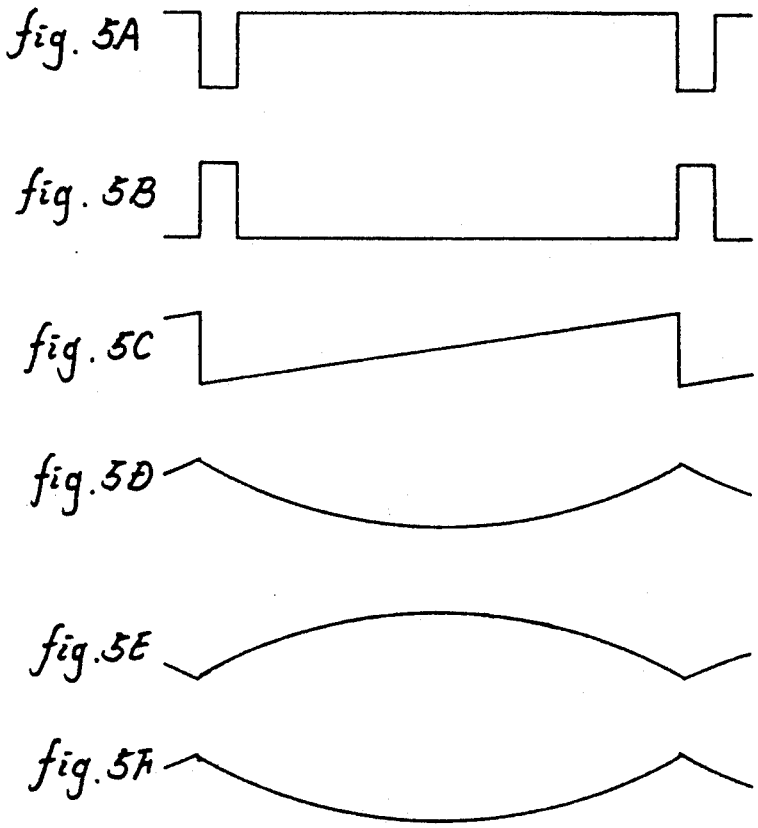
FIGS. 5A to 5F show the output waveforms generated by the several portions of the circuit shown in FIG. 4.

Referring to FIG. 1, there is illustrated a side pin cushion circuit according to an embodiment of the present invention comprising a vertical deflection portion 11 for generating a saw-tooth signal having a period varying according to the frequency of the vertical synchronizing signal. The period and maximum amplitude of the saw-tooth signal outputted from the vertical deflection portion 11 vary according to the frequency of the vertical synchronizing signal. When the frequency of the vertical synchronizing signal is approximately 50 to 70 Hz, the saw-tooth signal has a relatively large period and a maxium amplitude of a relatively low voltage V1. On the other hand, when the vertical synchronizing signal has a high frequency (for instance, 87 Hz), the saw-tooth signal has a relatively small period a maxium amplitude of a relatively high voltage V2, as shown in FIG. 3A.

The side pin cushion circuit also includes a buffer portion 12 comprising an operational amplifier 21 and a resistor R1 connected between an inverted input terminal of the operational amplifier 21 and a first power source GND. The operational amplifier 21 includes a feedback loop connected between its inverted input terminal and its output terminal, and a non-inverted input terminal for receiving a saw-tooth signal from the vertical deflection portion 11. The buffer portion 12 buffers and amplifies a saw-tooth signal having a large period such as that of FIG. 2A or a small period such as that of FIG. 3A, and supplies commonaly the amplified saw-tooth signal, as shown in FIG. 2B or FIG. 3B to a first amplifying portion 13 and a timer controller 15. The amplified saw-tooth signal has a period and maximum value identical to those of the inputted saw-tooth signal.

The first amplifying portion 13 comprises an operational amplifier 22 having a feedback resistor R2 connected between its non-inverted input terminal and its output terminal, a resistor R3 connected between an inverted input terminal of the operational amplifier 22 and the first power source GND, a serial circuit consisting of a capacitor R3 and a resistor R4 and connected between an output terminal of the operational amplifier 22 and the first power source GND, a capacitor C2 connected in parallel with the capacitor C1, and a capacitor C3 connected between the first power source input terminal of the operational amplifier 22 connected to the second power source −Vs and the first power source GND. The operational amplifier 22 integrates the saw-tooth signal supplied to its non-inverted input terminal from the output terminal of the operational amplifier 21 by a time constant determined by the resistor R2 and the capacitors C1 and C2 so as to generate a side pin cushion signal such as that of FIG. 2G or FIG. 3G. The operational amplifier 22 also amplifies the generated pin cushion signal and supplies the amplified pin cushion signal to a second amplifying portion 14.

The second amplifying portion 14 comprises an operational amplifier 23 whose a non-inverted input terminal is connected to a connection P1 between the two capacitors C1 and C2 and the resistor R4 of the first amplifying portion 13, and a resistor R6 connected between an inverted input terminal of the operational amplifier 23 and the first power source GND. The operational amplifier 23 amplifies the pin cushion signal supplied to its non-inverted input terminal through the resistor R5 and a variable resistor VR 1 from the connection P1, and supplies it to a mixer through a coupling capacitor C7 and an output terminal 19.

The side pin cushion circuit additionally comprises a controlling switch circuit 18 connected between the non-inverted input terminal of the operational amplifier 23 and the output terminal of the operational amplifier 23.

Meanwhile, the timer controller 15 receiving a saw-tooth signal from the output terminal of the operational amplifier 21 detects the frequency of the saw-tooth signal according to the maximum voltage of the saw-tooth signal and supplies to a timer 16 a logic signal of a predetermined logic state such as that of FIG. 2C or a pulse signal such as that of FIG. 3C according to the detected frequency mode. To perform this function, the timer controller 15 comprises a serial circuit consisting of a diode D1 and a resistor R7 and connected between the output terminal of the operational amplifier 21 and the base of the transistor Q1, and a resistor R8 connected between the base of the transistor Q1 and the first power source GND. The transistor Q1 has an collector connected to a third power source +Vs through a resistor R9 and an emitter connected to the first power source GND.

Also, the side pin in cushion circuit additionally comprises a timer 16 whose input terminal is connected to the collector of the transistor Q1. The timer 16 generates a pulse signal for keeping a high logic state for a predetermined time from the falling edge of the pulse signal supplied from the collector of the transistor Q1, and supplies it to a switching controller 17.

The switching controller 17 comprises a transistor Q2 whose base is connected to the output terminal of the timer 16 through a resistor R10, and a resistor R11 connected between the collector of the transistor Q2 and the third power source +Vs. The transistor Q2 inverts the pulse signal received through the resistor R10 from the timer 16 and supplies the inverted pulse signal to the control terminal of the controlling switch circuit 18 through its collector.

The side pin cushion circuit operates in one of two modes, according to the frequency of the vertical synchronizing signal. These two modes of operation are described as gollows.

First of all, when the vertical synchronizing signal has a comparatively low frequency F1 (i.e., has a period T1), the vertical deflection portion 11 generates a saw-tooth signal such as that of FIG. 2A having a large period corresponding to the frequency F1 of the vertical synchronizing signal, and supplies it to the non-inverted input terminal of the operational amplifier 21 within the buffer portion 12. At this time, the operational amplifier 21 buffers the saw-tooth signal and generates a buffered saw-tooth signal such as that of FIG. 2B. Since the peak value of this signal is V1 and its voltage difference with the grounded potential is small, it is voltage-divided by the diode D1 and two resistors R7 and R8 of the timer controller 15, converted to a logic signal of a low state as shown in FIG. 2C, and supplied to the base of the transistor Q1. Accordingly, the transistor Q1 is turned off, thereby inputting a logic signal of high state as shown in FIG. 2D to the timer 16. The timer 16 is set to generate a logic signal of low state as shown in FIG. 2E, when a logic signal of high state is inputted. The logic signal of low state thus outputted from the timer 16 is supplied to the base of the transistor Q2 through the resistor R10 so as to turn off the transistor Q2. Thus the collector potential of the transistor Q2 becomes a high logic state as shown in FIG. 2F, thereby turning off the controlling switch circuit 18. Meanwhile, the output signal of the buffer portion 12 is inputted to the non-inverted input terminal of the operational amplifier 22 within the first amplifying portion 13 and is amplified. At the same time, it is converted to a pin cushion signal as shown in FIG. 2G by two capacitors C1 and C2 and the resistors R2 to R4. The signal inputted to the second amplifying portion 14 is outputted through resistor R5, variable resistor VR1, the controlling switch circuit 18 and a capacitor C7 to be supplied to a mixer, and its amplitude is controlled by the variable resistor VR1.

In the second mode of operation of the side pin cushion circuit, when the vertical synchronizing signal has a relatively high frequency F2 (i.e., has a period T2), the vertical deflection portion 11 generates a saw-tooth signal as shown in FIG. 3A having a small period corresponding to the frequency F2 of the vertical synchronizing signal, and supplies it to the non-inverted terminal of the operational amplifier 21 within the buffer 12. At this time, the operational amplifier 21 buffers the saw-tooth signal as shown in FIG. 3A and generates a buffered saw-tooth signal as shown in FIG. 3B.

Since the peak value of the saw-tooth signal is V2 and its voltage difference with the grounded potential is large, it is voltage-divided by the diode D1 and two resistors R7 and R8, thereby being converted to a pulse signal as shown in FIG. 3C. That is, the pulse signal as shown in FIG. 3C, corresponding to the remaining signal level minus the voltage dropped by the diode D1 and the resistor R7 in the positive components of the signal of FIG. 3B, is supplied to the base of the transistor Q1. Accordingly, the transistor Q1 is turned on and off according to the input signal so as to supply the inverted pulse signal, as shown in FIG. 3D, to the timer 16. The timer 16 starts its operation at the falling edge of the input signal and generates a pulse signal, as shown in FIG. 3E, which keeps a high state during a predetermined interval. Then the transistor Q2 of the switching controller 7 inverts the output of the timer 16 and supplies an inverted pulse signal such as that of FIG. 3F to the control terminal of the controlling switch circuit 18. The controlling switch circuit 18 is turned off during the low state pulse interval, as with the inverted pulse signal shown in FIG. 3F. Meanwhile, the output signal of the buffer portion 12 is also amplified by the first amplifying portion 13 and at the same time is converted to the pin cushion signal as shown in FIG. 3G so as to be inputted to the non-inverted input terminal of the operational amplifier 23 of the second amplifying portion 14 through the resistor R5 and variable resistor VR1. Then, the operational amplifier 23 amplifies the converted pin cushion signal and supplies the amplified pin cushion signal to the mixer. In this case, the amplitude of the pin cushion signal outputted from the first amplifying portion 13 is controlled by the variable resistor VR1. The mixer, receiving the a pin cushion signal, amplitude-modulates the horizontal deflection signal of the saw-tooth waveform received from the horizontal deflection portion (not shown) by the pin cushion signal, and supplies the amplitude-modulated horizontal deflection signal to a deflection coil of the cathode ray tube.

As described above, when the frequency of the vertical synchronizing signal is changed, the present invention generates a switching pulse train of the frequency corresponding to the frequency of the vertical synchronizing signal and ascertains the period of the pin cushion signal which will be outputted, by the generated switching pulse train, so that it has the advantage of exactly keeping the period of the pin cushion signal to be supplied to the grid of the cathode ray tube regardless of the frequency of the vertical synchronizing signal.

What is claimed is:

1. A side pin cushion circuit in an image displaying device having a mixer for amplitude-modulating a horizontal deflection signal by a pin cushion signal and applying the amplitude modulated horizontal deflection signal to a deflection coil of a cathode ray tube comprising:

vertical deflection means for generating a saw-tooth signal whose period varies according to the frequency of a vertical synchronizing signal;

first amplifying means for amplifying the saw-tooth signal from said vertical deflection means and converting the amplified saw-tooth signal to a pin cushion signal;

second amplifying means for amplifying the pin cushion signal from said first amplifying means and supplying the amplified pin cushion signal to said mixer;

means for switching the pin cushion signal supplied to said mixer from said second amplifying means; and switch controlling means for detecting the frequency of the vertical synchronizing signal by the voltage level of the saw-tooth signal supplied from said vertical deflection means and controlling said switching means every period corresponding to the frequency of the detected vertical synchronizing signal.

2. A side pin cushion circuit as claimed in claim 1, wherein said switch controlling means comprises:

a timer controller for detecting the frequency of the vertical synchronizing signal depending on the voltage level of the saw-tooth signal received from said vertical deflection means and generating a pulse signal having a period corresponding to the frequency of said detected vertical synchronizing signal; and a timer for adjusting the width of the pulse signal from said timer controller and supplying the adjusted pulse signal to said switching means.

3. A side pin cushion circuit as claimed in claim 2, further comprising a buffer circuit connected between said vertical deflection means, said first amplifying means and said timer controller, for buffering the saw-tooth signal supplied from said vertical deflection portion.

4. A side pin cushion circuit as claimed in claim 3, wherein said timer controller includes:

means for clamping the vertical saw-tooth signal received from said buffer circuit and detecting the vertical saw-tooth signal above a predetermined voltage level; and means for waveform shaping into a square-wave signal the detected vertical saw-tooth signal above the predetermined voltage level supplied from said clamping means.

5. A side pin cushion circuit as claimed in claim 4, wherein said first amplifying means is a non-inverted amplifier comprising an operational amplifier.

* * * * *